US006966384B2

(12) United States Patent
Griffiths

(10) Patent No.: US 6,966,384 B2
(45) Date of Patent: Nov. 22, 2005

(54) DEPLOYING A CABLE THROUGH A GUIDE CONDUIT IN A WELL

(75) Inventor: Neil Griffiths, Rijswijk (NL)

(73) Assignee: Shell Oil Company, Houston, TX (US)

( * ) Notice: Subject to any disclaimer, the term of this patent is extended or adjusted under 35 U.S.C. 154(b) by 188 days.

(21) Appl. No.: 10/332,906

(22) PCT Filed: Jul. 4, 2001

(86) PCT No.: PCT/EP01/07691

§ 371 (c)(1),
(2), (4) Date: Apr. 11, 2003

(87) PCT Pub. No.: WO02/06625

PCT Pub. Date: Jan. 24, 2002

(65) Prior Publication Data

US 2003/0178203 A1 Sep. 25, 2003

(30) Foreign Application Priority Data

Jul. 13, 2000 (EP) ..... 00305968

(51) Int. Cl.[7] ..... E21B 41/00

(52) U.S. Cl. ..... 166/380; 166/65.1; 166/242.6; 174/65 R

(58) Field of Search ..... 166/380–382, 166/385, 65.1, 241.5, 242.2, 242.3, 242.5, 166/242.6; 439/207–210; 340/854.9, 855.1, 340/855.2; 174/65 R

(56) References Cited

U.S. PATENT DOCUMENTS

| | | | | |
|---|---|---|---|---|
| 2,512,226 A * | 6/1950 | Alton | ..... | 166/65.1 |
| 4,128,735 A * | 12/1978 | Zehren | ..... | 174/65 R |
| 5,233,304 A | 8/1993 | Hubans | | |
| 5,960,883 A * | 10/1999 | Tubel et al. | ..... | 166/65.1 |
| 6,302,203 B1 * | 10/2001 | Rayssiguier et al. | ..... | 166/65.1 |

FOREIGN PATENT DOCUMENTS

| | | | | |
|---|---|---|---|---|
| EP | 0 721 053 A1 | 7/1996 | ..... | E21B 47/12 |
| EP | 0 964 134 A2 | 12/1999 | ..... | E21B 47/12 |

* cited by examiner

*Primary Examiner*—David Bagnell
*Assistant Examiner*—Matthew J. Smith
(74) *Attorney, Agent, or Firm*—Rachael Stiegel

(57) ABSTRACT

A fiber optical or other cable is inserted through a pre-installed guide conduit in a well by: installing an upper part of the guide conduit permanently in the well such that it is embedded in the annular cement body at the outer surface of a casing string between a wellhead and an outer component of a guide conduit connector which is located near a lower end of the casing string; installing a lower part of the guide conduit in the well such that it extends alongside the outer surface or is an integral part of a liner string down from an inner component of the guide conduit connector which is located near an upper end of the liner string; aligning the inner and outer components of the guide conduit connector with each other; and pumping the cable down through the thus interconnected upper and lower parts of the guide conduit.

4 Claims, 1 Drawing Sheet

DEPLOYING A CABLE THROUGH A GUIDE CONDUIT IN A WELL

BACKGROUND OF THE INVENTION

Figure 1:
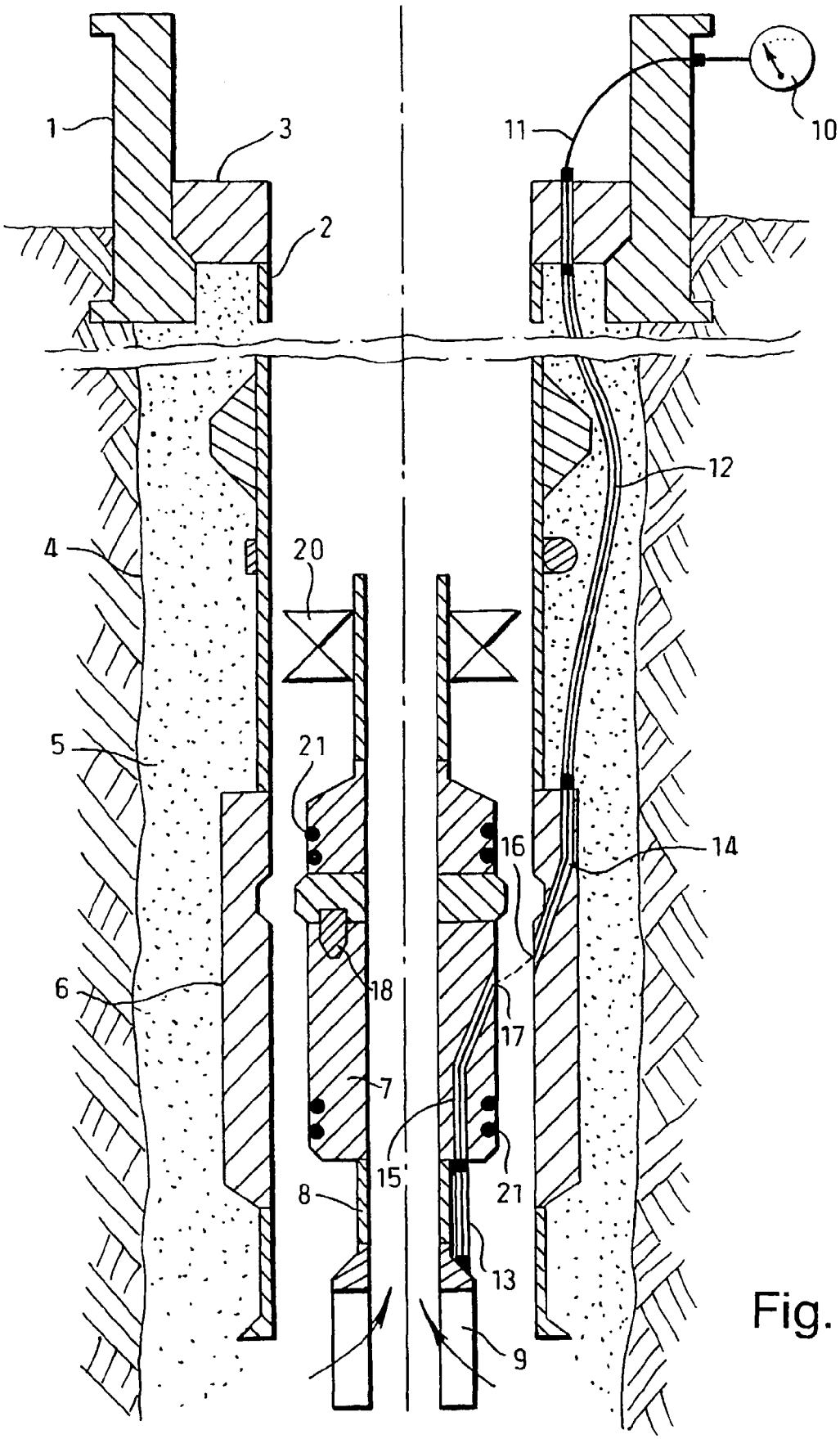

The invention relates to a method of deploying a fibre-optical cable or other power and/or signal transmission cable through a pre-installed guide conduit in a well.

It is known to pre-install a small guide conduit in the production tubing or in the production tubing/casing annulus of a well and to subsequently pump a fibre optical cable down through the guide conduit.

However, well equipment, such as a downhole electrical submersible pump (known as "ESP") or a downhole safety or control valve may make it difficult or even impossible to install such a guide conduit.

The present invention aims to overcome the difficulty of installing a fibre optical or other cable and guide conduit in a well which may contain equipment such as an ESP or downhole valves. The present invention also aims to install a guide conduit and cable such that the risk of damage to the cable during the lifetime of the well is minimized.

SUMMARY OF THE INVENTION

The method according to the invention comprises the steps of:

- installing an upper part of the guide conduit permanently in the well such that it extends alongside the outer surface of a casing string between a wellhead and an outer component of a guide conduit connector which is located near a lower end of the casing string and which forms a port opening in the inner surface of the casing;
- installing a lower part of the guide conduit in the well such that it extends alongside the outer surface or is an integral part of the liner string down from an inner component of a guide conduit connector which is located near an upper end of the liner string and which forms a port opening in the outer surface of the liner;
- aligning the inner and outer components of the guide connector with each other; and
- inserting the power and/or signal transmission cable through the thus interconnected upper and lower parts of the guide conduit.

Accordingly the upper part of the guide conduit does not form an obstacle for any operation or maintenance activity in the well since the guide conduit is usually embedded in a cement body that fixes the casing in the wellbore and the cable contained in the guide conduit is well protected against damage.

Preferably, the outer component of the guide conduit connector forms a profiled tubular receptacle near the lower end of the casing string and the inner component of the guide conduit connector forms a profiled cylindrical surface on the outer surface of the liner near a liner hanger which in use is suspended within the casing and wherein the inner and outer components of the guide conduit connector are provided with orienting means to orient the inner component in a predetermined angular orientation within the outer component such that said port openings are in alignment with each other.

To enable a smooth insertion of the cable through the guide conduit it is preferred that the guide conduit only has a smooth curvature at the location of the guide conduit connector.

To this end it is preferred that the port openings of said inner and outer components of the guide conduit connector define in use a central axis which intersects a longitudinal axis of the casing string and liner hanger assembly at an acute angle.

DESCRIPTION OF A PREFERRED EMBODIMENT

The invention will be described in more detail with reference to the accompanying FIG. 1, which is a longitudinal sectional view of a well which is equipped with a fibre optical cable and split guide conduit according to the invention.

The well shown in FIG. 1 has a wellhead 1 in which a casing 2 is suspended by means of a casing hanger 3. The casing 2 is cemented in the wellbore 4 by means of an annular body of cement 5.

The casing 2 is provided near its lower end with a profiled tubular receptacle 6 in which a profiled cylindrical inner component 7 of a guide conduit connector is suspended which forms part of a liner 8.

A sand screen 9 is arranged at he lower end of the liner 8 and in use oil, gas and/or water flows through the sand screen 9 into the liner 8.

A fibre optical cable 11 is shown connected to a power and communications module 10. The fiber optical cable 11, in which a set of multisensors (not shown) is incorporated for measuring pressure, temperature and composition of fluid flowing through the screen 9, passes through a guide conduit of which the upper end 12 passes through the annular cement body 5 surrounding the casing string 2. Alternatively the fibre optical cable 11 itself forms a multisensor by virtue of the dependency of the light transmission characteristics of the cable 11 on pressure, temperature and fluid composition. In this way the entire length of the well can be equipped with sensors for monitoring the said parameters.

The lower part 13 of the guide conduit extends between the inner component 7 of the guide conduit connector and the sand screen 9. The upper and lower parts 12 and 13 of the guide conduit are interconnected by the guide conduit connector 6, 7. The tubular outer component of the connector comprises a bore 14 in the tubular receptacle 6. The cylindrical inner component 7 of the connector comprises a bore 15.

The bore 14 in the outer component 6 of the guide conduit connector terminates as a port opening 16 in the cylindrical inner surface of the outer component 6 and the bore 15 in the inner component 7 of the connector terminates as a port opening 17 in the cylindrical outer surface of said inner component 7.

To ensure that the port openings 16 and 17 are aligned the inner component 7 of the guide conduit connector is equipped with a series of profiled dogs 18, which orient said inner component 7 automatically at a pre-determined angular orientation inside the outer component 6.

For the sake of clarity of the drawing a large annular spacing is shown between the inner and outer components 6 and 7 of the connector. However, it will be understood that in practice this clearance will be minimal and be limited to less than a few millimetres only.

In order to sealingly secure the liner 8 in the casing 2 a liner hanger and packer assembly 20 is arranged at the upper end of the liner 8. Furthermore, sealing rings 21 are arranged at the upper and lower ends of the cylindrical outer surface of inner component 7 of the conduit connector to provide a fluid seal between the annulus present between the cylindrical surfaces of the inner and outer components 6 and 7 of the guide conduit connector and the rest of the wellbore so that the fibre optical cable 11 can be easily pumped from the upper part 12 of the guide conduit via bores 14 and 15 in the guide conduit connector components 6 and 7 into the lower part 13 of the guide conduit.

What is claimed is:

1. A method of deploying a power and/or signal transmission cable through a pre-installed guide conduit in a well, the method comprising:

installing an upper part of the guide conduit permanently in the well such that it extends alongside the outer surface of a casing string between a wellhead and an outer component of a guide conduit connector which is located near a lower end of the casing string and which forms a port opening in the inner surface of the casing;

installing a lower part of the guide conduit in the well such that it extends alongside the outer surface or is an integral part of a well liner string down from an inner component of the guide conduit connector which is located near an upper end of the liner string and which forms a port opening in the outer surface of the liner;

aligning the inner component with the outer component of the guide conduit connector; and inserting the power and/or signal transmission cable through the thus interconnected upper and lower parts of the guide conduit.

2. The method of claim 1, wherein the outer component of the guide conduit connector forms a profiled tubular receptacle near the lower end of the casing string and the inner component of the guide conduit connector forms a profiled cylindrical surface on the outer surface of the liner near a liner hanger which in use is suspended within the casing string and wherein the inner and outer components of the guide conduit connector are provided with orienting means to orient the inner component in a predetermined angular orientation within the outer component such that said port openings are in alignment with each other.

3. The method of claim 2, wherein the port openings of said inner and outer components of the guide conduit connector define in use a central axis which intersects a longitudinal axis of the casing string and liner hanger assembly at an acute angle.

4. The method of claim 1, wherein the power and/or signal transmission cable is a fibre optical cable.

* * * * *